US011758637B2

(12) United States Patent
Wang

(10) Patent No.: US 11,758,637 B2
(45) Date of Patent: Sep. 12, 2023

(54) LIGHTING DEVICE WITH TRIAC AND WIRELESS DIMMING CONTROL

(71) Applicant: Tiejun Wang, Lin'an (CN)

(72) Inventor: Tiejun Wang, Lin'an (CN)

( * ) Notice: Subject to any disclaimer, the term of this patent is extended or adjusted under 35 U.S.C. 154(b) by 80 days.

(21) Appl. No.: 17/510,985

(22) Filed: Oct. 26, 2021

(65) Prior Publication Data

US 2023/0126814 A1 Apr. 27, 2023

(51) Int. Cl.

| | |
|---|---|
| ***H05B 47/19*** | (2020.01) |
| ***H05B 45/20*** | (2020.01) |
| ***H05B 45/10*** | (2020.01) |

(52) U.S. Cl.

CPC ..... *H05B 47/19* (2020.01); *H05B 45/10* (2020.01); *H05B 45/20* (2020.01)

(58) Field of Classification Search

CPC .... H05B 47/19; H05B 45/3725; H05B 45/00; H05B 47/105; H05B 47/13; H05B 47/11; H05B 45/10; H05B 47/195; H05B 47/16; Y02B 20/40; H02J 9/065; F21Y 2115/10; F21Y 2115/15; F21Y 2101/00; Y04S 20/20; Y04S 20/221; Y04S 20/246; Y04S 40/12; Y04S 40/124; F21V 23/0442; F21V 17/02; F21V 21/0824; F21V 21/30; F21V 23/0435; F21V 23/0471

See application file for complete search history.

(56) References Cited

U.S. PATENT DOCUMENTS

| | | | | |
|---|---|---|---|---|
| 11,503,688 | B2 * | 11/2022 | Kumar | H05B 45/20 |
| 2010/0271802 | A1 * | 10/2010 | Recker | H05B 45/12 362/20 |
| 2010/0327766 | A1 * | 12/2010 | Recker | H02J 50/40 362/20 |
| 2011/0121654 | A1 * | 5/2011 | Recker | H05B 45/3725 307/64 |
| 2011/0133655 | A1 * | 6/2011 | Recker | H05B 47/13 315/159 |
| 2012/0026726 | A1 * | 2/2012 | Recker | H05B 47/13 362/157 |
| 2012/0043889 | A1 * | 2/2012 | Recker | H05B 45/385 315/86 |
| 2012/0080944 | A1 * | 4/2012 | Recker | H05B 47/16 307/25 |
| 2013/0201316 | A1 * | 8/2013 | Binder | H04L 67/12 701/2 |
| 2015/0279207 | A1 * | 10/2015 | Breuer | H05B 45/12 340/12.5 |

(Continued)

*Primary Examiner* — Monica C King
(74) *Attorney, Agent, or Firm* — Daniel M. Cohn; Howard M. Cohn

(57) ABSTRACT

Disclosed embodiments provide a lighting device that is controllable both by a triac device as well as by wireless control. When intelligent lamps are installed in indoor applications, there can be technical problems of lamp mismatch due to a triac dimmer. Disclosed embodiments provide a compatibility device. In disclosed embodiments, when the triac dimmer is in high output, at or above a predetermined threshold, a wireless controller can control the brightness, color temperature and RGB (red-green-blue) output of coupled lamps. When the triac dimmer is below the predetermined threshold, the wireless controller is not controlling dimming, the triac dimmer can control the brightness and/or color temperature of coupled lamps (LED lights).

20 Claims, 6 Drawing Sheets

(56) References Cited

U.S. PATENT DOCUMENTS

| | | | | |
|---|---|---|---|---|
| 2016/0330825 | A1* | 11/2016 | Recker | H05B 47/115 |
| 2017/0099572 | A1* | 4/2017 | Breuer | H05B 47/175 |
| 2017/0180046 | A1* | 6/2017 | Stout | G01C 21/20 |
| 2017/0201011 | A1* | 7/2017 | Khripkov | H01Q 1/42 |
| 2017/0223807 | A1* | 8/2017 | Recker | H02J 9/02 |
| 2017/0231058 | A1* | 8/2017 | Sadwick | H05B 45/18 |
| 2018/0077770 | A1* | 3/2018 | Sooch | H05B 45/20 |
| 2018/0077783 | A1* | 3/2018 | Sooch | H05B 45/28 |
| 2018/0220506 | A1* | 8/2018 | Sadwick | H05B 47/18 |
| 2018/0279429 | A1* | 9/2018 | Sadwick | H05B 45/3725 |
| 2018/0375576 | A1* | 12/2018 | Stout | G08B 7/066 |
| 2019/0020110 | A1* | 1/2019 | Paulotto | H01Q 5/20 |
| 2019/0021154 | A1* | 1/2019 | Sadwick | H05B 45/34 |
| 2019/0035569 | A1* | 1/2019 | Sadwick | H05B 45/20 |
| 2019/0089400 | A1* | 3/2019 | Zihir | H03F 3/45475 |
| 2019/0098725 | A1* | 3/2019 | Sadwick | F21S 2/00 |
| 2019/0215927 | A1* | 7/2019 | Sooch | H05B 47/16 |
| 2019/0320515 | A1* | 10/2019 | Sadwick | H05B 45/00 |
| 2022/0201820 | A1* | 6/2022 | Kumar | H05B 45/385 |

* cited by examiner

LIGHTING DEVICE WITH TRIAC AND WIRELESS DIMMING CONTROL

FIELD

The present invention relates generally to lighting control, and more particularly to a lighting device with triac and wireless dimming control.

BACKGROUND

Today a wide variety of technologies exist for providing light in homes and other buildings. These include incandescent lighting, fluorescent lighting, and Light Emitting Diode (LED) lighting. LED lighting has an advantage of providing large amounts of light with relatively low energy consumption.

An LED is a semiconductor light source. An LED includes a PN Junction Diode, and when voltage is applied to the LED, electrons and holes recombine in the PN Junction and release energy in the form of light (Photons). The light emitted by an LED is usually monochromatic i.e., of single color, and the color is dependent on the energy band gap of the semiconductor. Light Emitting Diodes can be manufactured to emit all the wavelengths of visible spectrum, from red (620 nm to 750 nm) to blue—violet (380 nm to 490 nm). LEDs can be combined to make combined light that is a mixture of light of various wavelengths.

Light Emitting Diode (LED) lighting is currently available in a wide variety of home and industrial products. The rapid development of LED technology leads to more products and improved manufacturing efficiency, which also results in lower prices. The reduced power requirements as compared with incandescent lighting enables portable lighting applications such as flashlights, vehicle lights, and more.

The spectral power distribution (SPD) of a blackbody radiator can be completely determined from its absolute, or color temperature in Kelvin (K). Correlated color temperature (CCT) is a measure of light source color appearance defined by the proximity of the light source's chromaticity coordinates to the blackbody locus, as a single number rather than the two required to specify a chromaticity. Practical light sources of different SPD but identical chromaticities will also have identical CCTs In terms of correlated color temperature, a warm light is around 2700K, moving to neutral white at around 4000K, and to cool white, at 5000K or more. Since it is a single number, CCT is simpler to communicate than chromaticity or SPD, leading the lighting industry to accept CCT as a shorthand means of reporting the color appearance of "white" light emitted from electric light sources.

Lighting plays an important role in the design and usability of interior spaces. Different situations may call for different lighting conditions. For example. the ideal lighting for use while preparing a meal in the kitchen may be different from the ideal lighting for watching a movie after dinner. It is therefore desirable to have improvements in lighting control.

SUMMARY

Embodiments can include an apparatus comprising: an LED driver, the LED driver comprising a control circuit and a dimming circuit, wherein the dimming circuit is configured and disposed to receive an input signal from the control circuit; a triac configured and disposed to provide a first signal to the control circuit; a microcontroller, configured and disposed to provide a second signal to the control circuit; a wireless communication interface coupled to the microcontroller; wherein the control circuit is configured and disposed to provide the first signal to the dimming circuit when the first signal is above a predetermined threshold, and wherein the control circuit is configured and disposed to provide the second signal to the dimming circuit when the first signal is at or below the predetermined threshold.

Additional embodiments can include an apparatus comprising: an integrated control unit, comprising: an LED driver, the LED driver comprising a control circuit and a dimming circuit, wherein the dimming circuit is configured and disposed to receive an input signal from the control circuit; a triac configured and disposed to provide a first signal to the control circuit; a microcontroller, configured and disposed to provide a second signal to the control circuit; a wireless communication interface coupled to the microcontroller; wherein the control circuit is configured and disposed to provide the first signal to the dimming circuit when the first signal is above a predetermined threshold, and wherein the control circuit is configured and disposed to provide the second signal to the dimming circuit when the first signal is at or below the predetermined threshold.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting.

Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

Figure 1A:
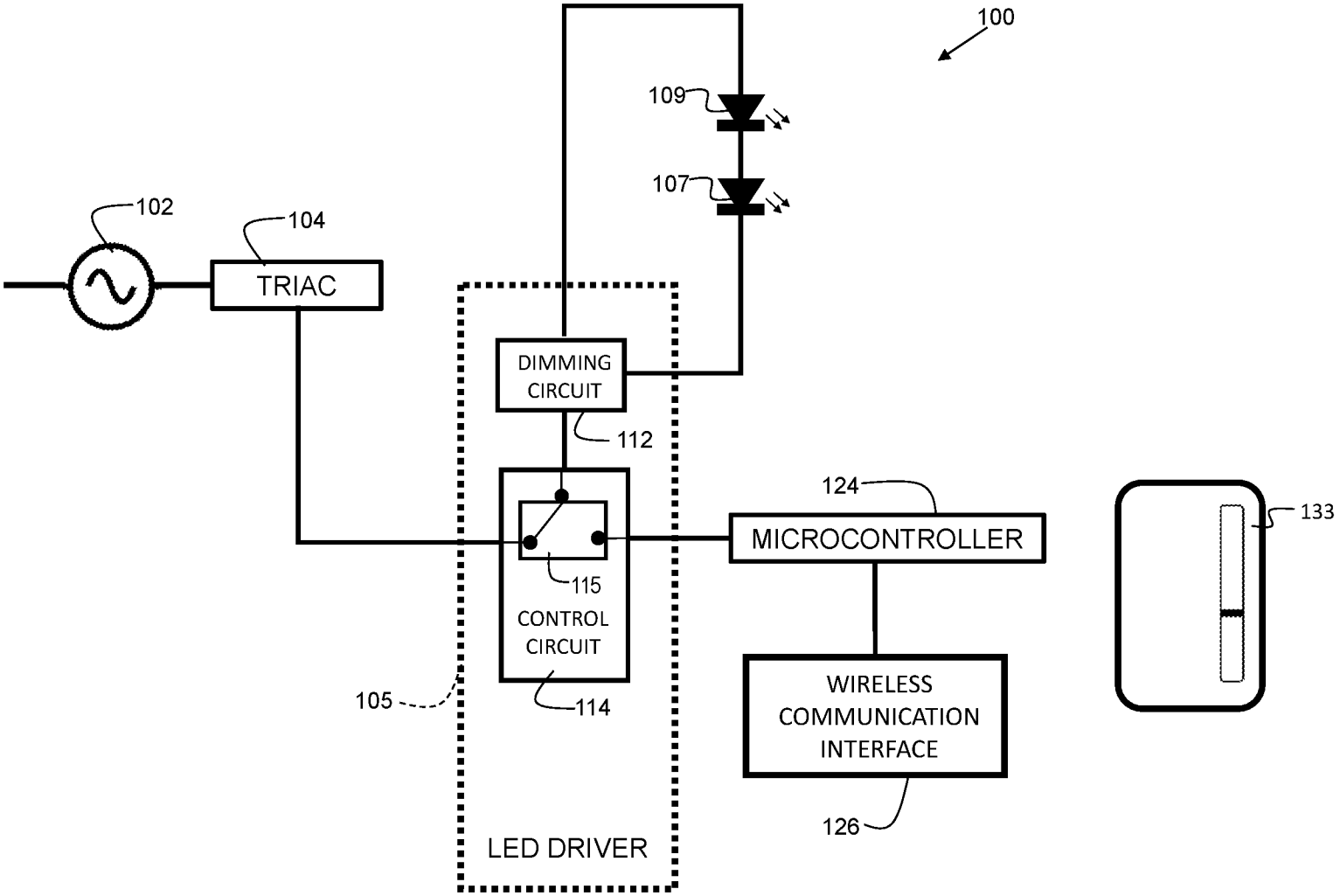

In some cases, similar elements may be referred to by similar numbers in various figures (FIGs) of the drawing, in which case typically the last two significant digits may be the same, the most significant digit being the number of the drawing figure (FIG). Furthermore, for clarity, some reference numbers may be omitted in certain drawings.

FIG. 1A shows a block diagram of an embodiment of the present invention in a triac-controlled configuration.

Figure 1B:
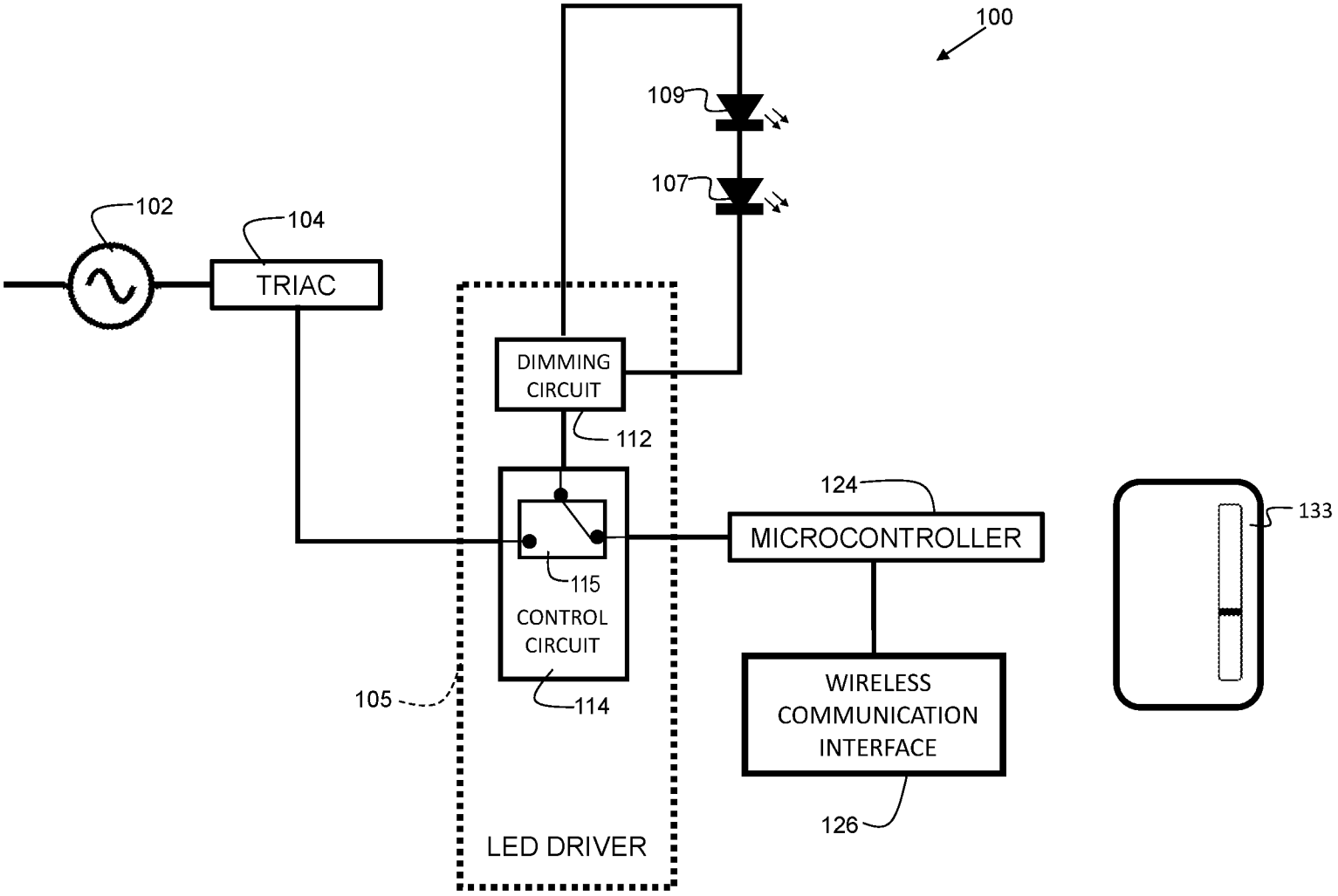

FIG. 1B shows a block diagram of an embodiment of the present invention in a wireless-controlled configuration.

Figure 2:
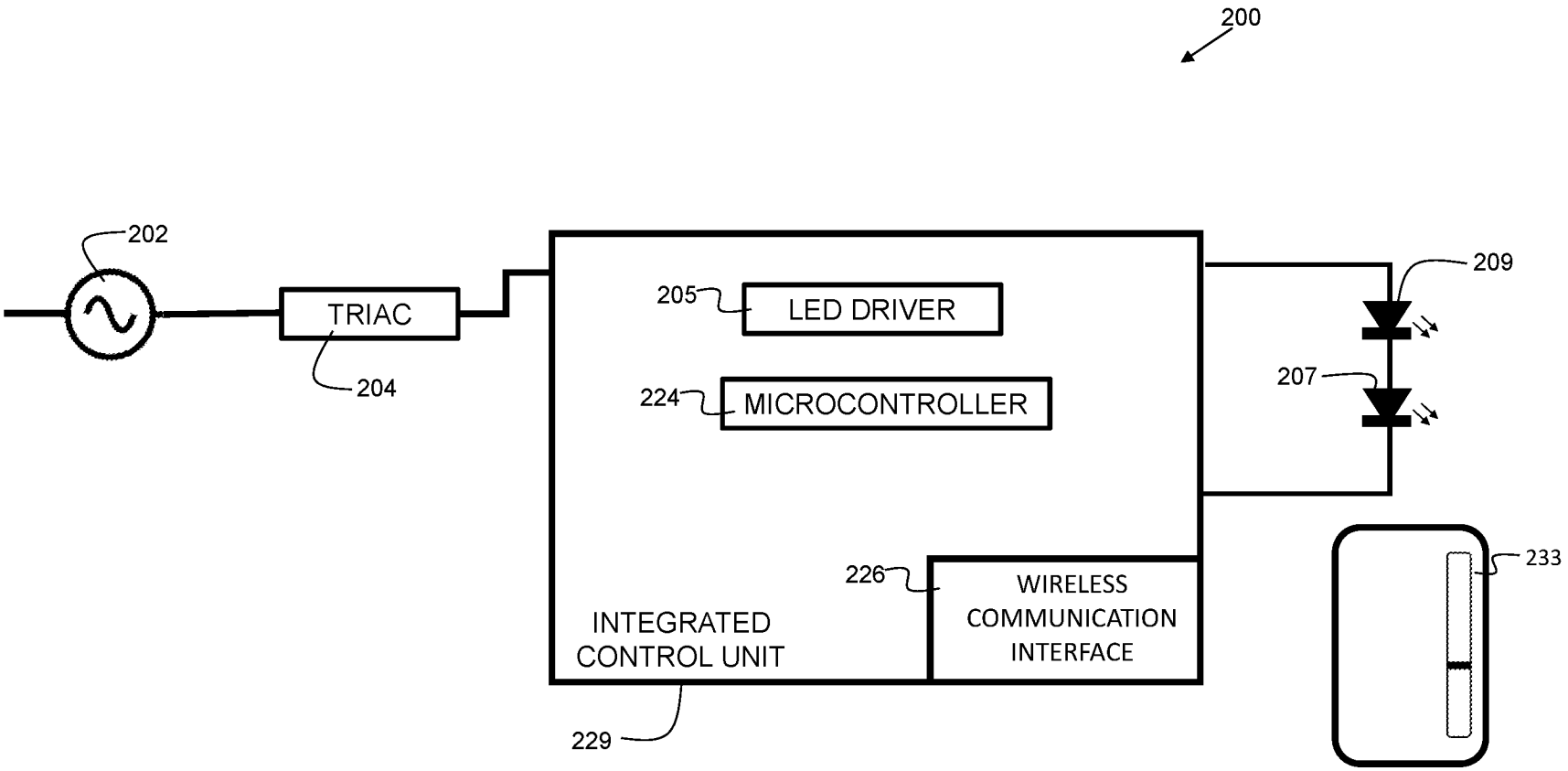

FIG. 2 shows a block diagram of an additional embodiment of the present invention.

Figure 3:
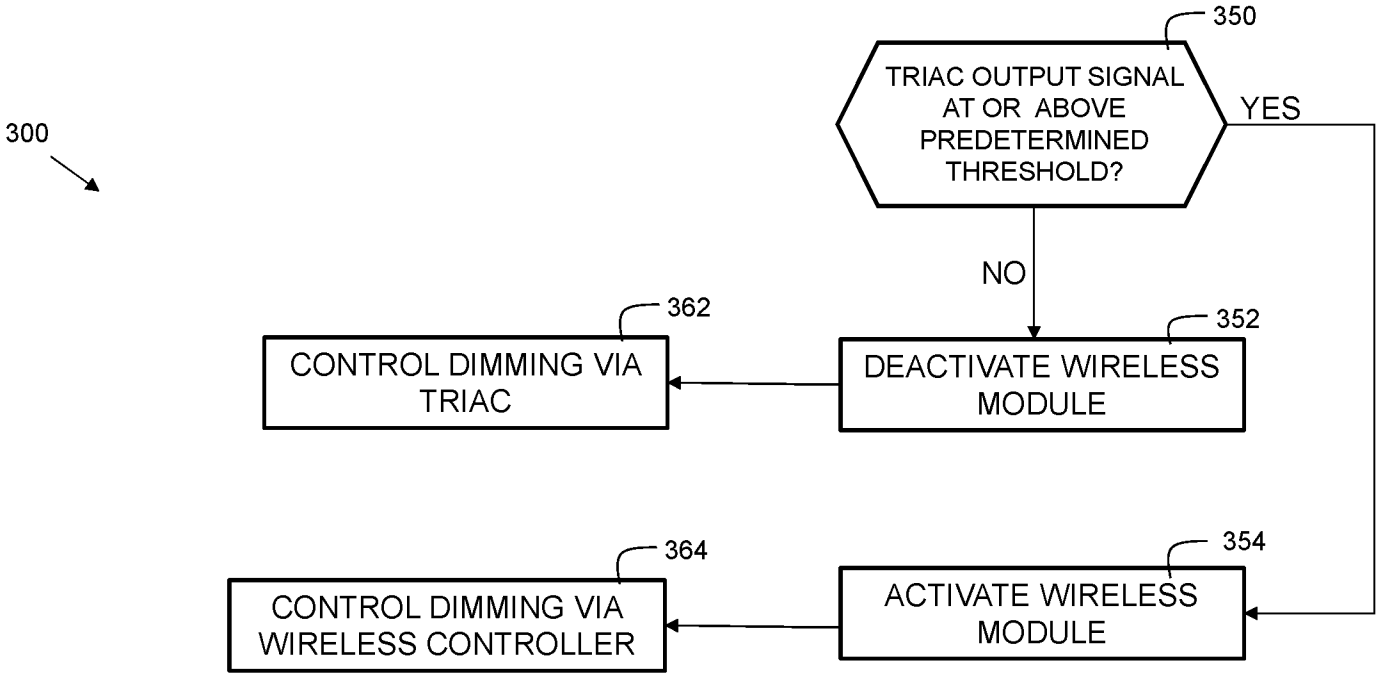

FIG. 3 is a flowchart indicating process steps for embodiments of the present invention.

Figure 4B:
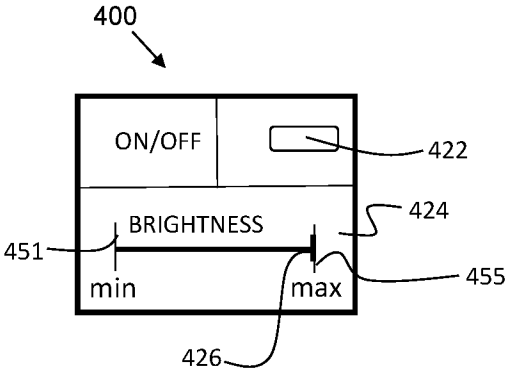
Figure 4A:
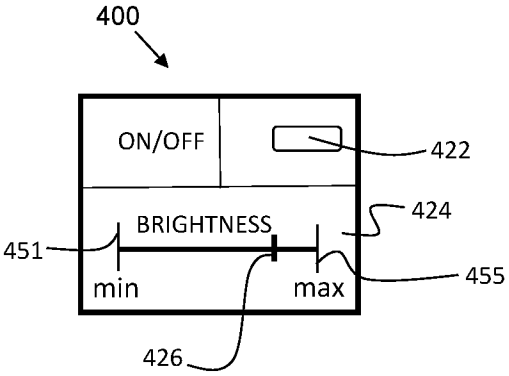

FIG. 4A shows an example of a triac dimming device in accordance with embodiments of the present invention in an intermediate position.

FIG. 4B shows an example of a triac dimming device in accordance with embodiments of the present invention in a maximum brightness configuration.

Figure 5:
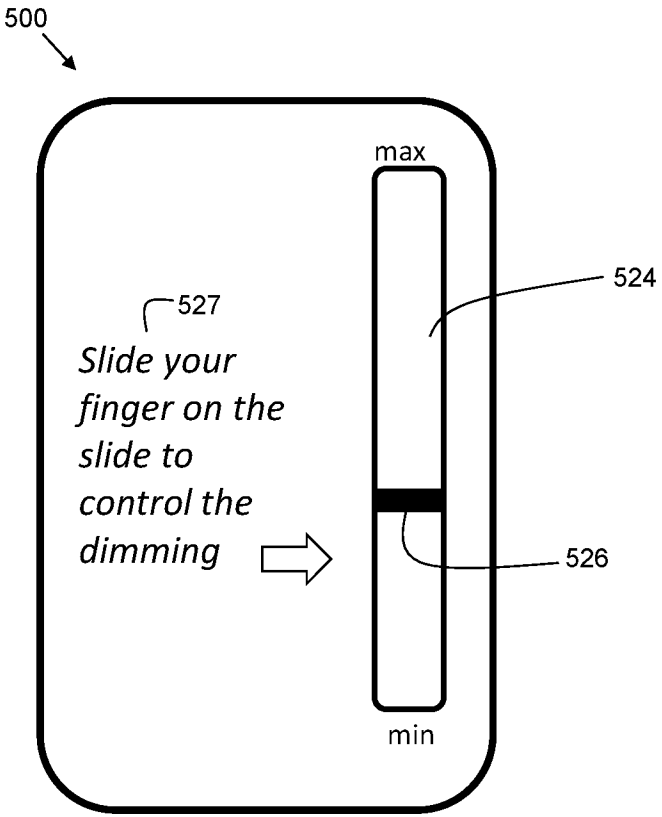

FIG. 5 shows a user interface indicating wireless control is enabled.

Figure 6:
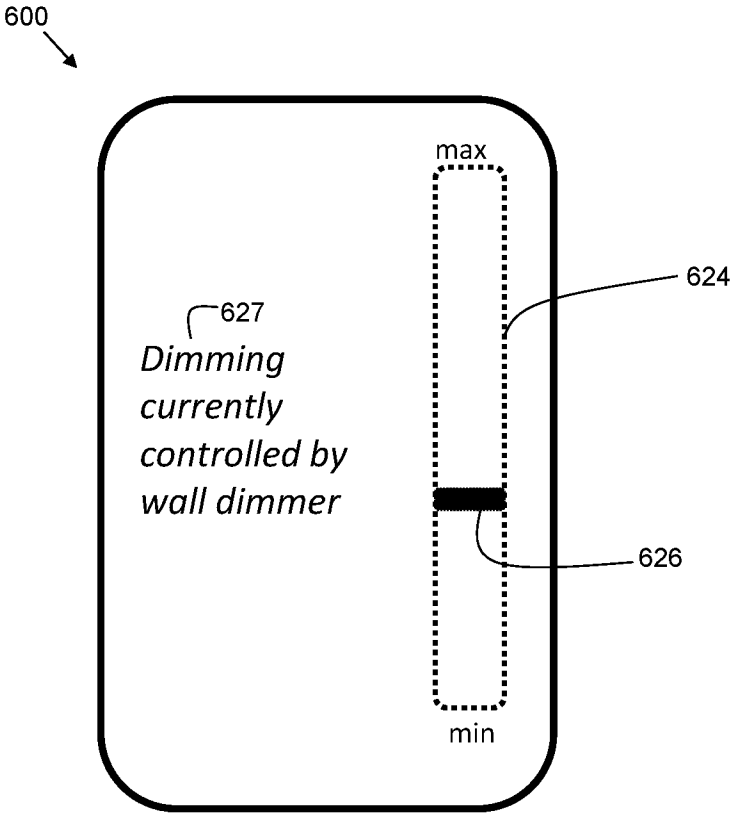

FIG. 6 shows a user interface indicating wireless control is disabled.

DETAILED DESCRIPTION

A triac is a bidirectional, three-electrode AC switch that allows electrons to flow in either direction. It is the equivalent of two SCRs connected in a reverse-parallel arrangement with gates connected to each other. A triac is triggered into conduction in both directions by a gate signal like that of an SCR. Triacs can enable the development of improved AC power controls. Triacs are available in a variety of packaging arrangements. They can handle a wide range of current and voltage. Triacs are versatile because of their ability to operate with positive or negative voltages across their terminals.

Disclosed embodiments provide a lighting device that is controllable both by a triac device as well as by wireless control. When intelligent lamps are installed in indoor applications, there can be technical problems of lamp mismatch due to a triac dimmer. Disclosed embodiments provide a compatibility device. In disclosed embodiments, when the triac dimmer is in high output, a wireless controller can control the brightness, color temperature and RGB (red-green-blue) output of coupled lamps. When the wireless controller is not controlling dimming, the triac dimmer can control the brightness and/or color temperature of coupled lamps (LED lights).

FIG. 1A shows a block diagram of an embodiment 100 of the present invention in a triac-controlled configuration. FIG. 1B shows a block diagram of embodiment 100 of the present invention in a wireless-controlled configuration. Embodiment 100 includes a triac dimmer 104. The dimmer 104 is coupled to an alternating current (AC) power source 102 (e.g., 120V AC). The dimmer 104 provides a conditioned signal as an input to LED driver 105. LED driver 105 carefully controls the current delivered to one or more LED light-emitting devices. Two LED light-emitting devices, indicated as 107 and 109, are shown in FIG. 1A and FIG. 1B. Other embodiments may have more or fewer light-emitting devices. Embodiments can include a plurality of LEDs, wherein the LEDs are coupled to the LED driver. In some embodiments, the plurality of LEDs comprises a first LED and a second LED. In some embodiments, the first LED is configured to emit a first white light of a first correlated color temperature (CCT); and the second light-emitting device is configured to emit a second white light of a second CCT. In some embodiments, the first correlated color temperature (CCT) has a value of 5000K and wherein the second CCT has a value of 2000K. In some embodiments, some of the light-emitting devices may have different CCT values. In embodiments, the light from the first and second light-emitting devices mix to form a combined-light CCT, and a combined-light brightness. In some embodiments, the first LED and second LED comprise RGB (red-green-blue) LEDs, wherein each color component is individually controllable.

The LED driver 105 comprises a control circuit 114. The control circuit may include solid state and/or electromechanical switches to enable control of a coupled dimming circuit 112. The control circuit is configured and disposed to provide an input to the dimming circuit 112. The input to the dimming circuit 112 can be based on a signal from the triac dimmer 104, or from a microcontroller 124.

The microcontroller 124 includes multiple General-Purpose Input/Output (GPIO) pins for receiving inputs and producing outputs to implement various features of disclosed embodiments. The microcontroller 124 is coupled to a wireless communication interface 126. In some embodiments, wireless communication interface 131 may include a Wi-Fi interface, Bluetooth interface, infrared (IR) interface, and/or ZigBee interface. In some embodiments, wireless communication interface 131 may include a radio transceiver, such as a Wi-Fi transceiver, ZigBee transceiver, and/or a Bluetooth transceiver, enabling control of the LED driver 105 from a remote electronic device 133. In some embodiments, remote device 133 may be a smartphone or tablet computer that utilizes Wi-Fi, ZigBee, and/or Bluetooth to provide desired dimming and/or CCT values to apparatus 100. In some embodiments, the wireless communication interface 131 may include an infrared receiver, and remote device 133 may include an infrared transmitter, in order to provide desired dimming and/or CCT values to apparatus 100.

In some embodiments, the GPIO pins can include a switch selection signal as an input to the microcontroller 124, from the control circuit 114 of the LED driver 105. The switch selection signal can be used by the microcontroller 124 to receive a status as to if the dimming can be controlled by the wireless communication interface 126. Thus, in embodiments, the control circuit is configured and disposed to provide a switch selection signal as an input to the microcontroller.

The dimming circuit 112 may include one or more pulse-width modulation (PWM) circuits for operating the lights 107 and 109 when under wireless control. The control circuit 114 may have a sensing circuit 115 that senses the output level (voltage and/or current level) of the triac dimmer 104. When the sensing circuit indicates that the triac output signal is at maximum output, the input to dimming circuit 112 is switched to be from the microcontroller 124. When the sensing circuit indicates that the triac output signal is not at maximum output, the input to dimming circuit 112 is switched to be from the triac. In embodiments, the triac may be embodied in a wall-mounted switch. In this way, disclosed embodiments provide both wall-mounted triac control of light dimming, as well as wireless control of light dimming.

As shown in FIG. 1A, the control circuit 114 is configured such that the sensing circuit 115 detects an output signal from the triac dimmer 104 that is below a predetermined threshold, and as such, the triac output is switched to be the input to dimming circuit 112, and the triac 104 plays a major regulating role. In contrast, as shown in FIG. 1B, the control circuit 114 is configured such that the sensing circuit 115 detects an output signal from the triac dimmer 104 that is at or above the predetermined threshold, and as such, the output of microcontroller 124 is switched to be the input to dimming circuit 112. The output of microcontroller 124 can be a GPIO pin that outputs a voltage, PWM signal, or other suitable signal for inputting to the dimming circuit 112. In embodiments, the control circuit is configured and disposed to provide the first signal to the dimming circuit when the first signal is above a predetermined threshold, and the control circuit is configured and disposed to provide the second signal to the dimming circuit when the first signal is at or below the predetermined threshold. In some embodiments, the predetermined threshold may have a value ranging from 9 volts to 10 volts. Other threshold values are possible in disclosed embodiments.

FIG. 2 shows a block diagram of an additional embodiment 200 of the present invention. Embodiment 200 includes integrated control unit 229. Triac dimmer 204 provides input to integrated control unit 229. The dimmer 204 is coupled to an alternating current (AC) power source 202 (e.g., 120V AC). The integrated control unit 229 houses LED driver 205, which is similar in functionality to LED driver 105 of FIG. 1A and FIG. 1B. Integrated control unit 229 also may house microcontroller 224 and wireless communication interface 226. Microcontroller 224 may be similar to microcontroller 124 of FIG. 1A and FIG. 1B. Similarly, wireless communication interface 226 may be similar to wireless communication interface 126 of FIG. 1A and FIG. 1B. In some embodiments, remote device 233 may be a smartphone or tablet computer that utilizes Wi-Fi, ZigBee, and/or Bluetooth to provide desired dimming and/or CCT values to apparatus 200.

In embodiments, the microcontroller (124 or 224) adjusts the output of the light-emitting devices based on input signals from user input devices such as triac dimmer (104 or 204) and/or remote device (133/233), and may further use information in lookup tables, and/or formulas stored in a computer-readable medium within the microcontroller. In embodiments, the microcontroller (124 or 224) is configured such that the signal provided to the LED driver comprises a pulse-width modulated (PWM) signal.

LED driver 205 carefully controls the current delivered to one or more LED light-emitting devices. Two LED light-emitting devices, indicated as 207 and 209, are shown in FIG. 2. Other embodiments may have more or fewer light-emitting devices. In some embodiments, some of the light-emitting devices may have different CCT values. In embodiments, the light from the first and second light-emitting devices mix to form a combined-light CCT, and a combined-light brightness.

FIG. 3 is a flowchart 300 indicating process steps for embodiments of the present invention. At 350 a check is made to determine if the triac is in a max brightness configuration. In embodiments, this may be performed via voltage-sensing circuitry that can sense an alternating current voltage level and/or a direct current voltage level. The voltage-sensing circuitry may include an optocoupler, one or more diodes, resistors, capacitors, inductors, and/or other passive and/or active electronic components. If no at 350, then the wireless module is deactivated at 352, and the dimming is controlled via triac dimmer at 362. This configuration is indicated in FIG. 1A. If yes at 350, then the wireless module is activated at 354, and the dimming is controlled via wireless controller at 364. This configuration is indicated in FIG. 1B.

FIG. 4A shows an example of a triac dimming device 400 in accordance with embodiments of the present invention in an intermediate position. Triac dimming device 400 may include an on/off switch 422, as well as a brightness control 424. As shown in FIG. 4A, the brightness control 424 of dimming device 400 is a slider 426. Other embodiments may include a rotary knob, or other suitable dimming control. As can be seen in FIG. 4A, the slider 426 is at an intermediate position between minimum 451 and maximum 455. FIG. 4B shows an example of a triac dimming device 400 in accordance with embodiments of the present invention in a maximum brightness configuration. As can be seen in FIG. 4B, the slider 426 is at the position of maximum 455, causing the apparatus to be in the configuration where the wireless controller can control the brightness of lamps, such as indicated in FIG. 1B.

FIG. 5 shows a user interface 500 indicating wireless control is enabled. User interface 500 may be implemented on a smartphone, tablet computer, or other electronic computing device with a touchscreen display such as remote electronic device 133.

In embodiments, a user-interface component is displayed, such as on a display screen (e.g., of remote device 133 and/or 233). An example of a displayed user-interface component is a virtual component, i.e., an image (e.g., on a touchscreen) that simulates a physical component, such as a virtual (displayed image of) a slider or a knob. Virtual user-adjustable components might be moved by the user swiping the virtual component on a touch screen or by the user grabbing-and-moving the virtual component with a mouse.

As shown in FIG. 5, there is a dimming control 524 that includes a slider icon 526. A user can use his finger and/or a stylus to move the slider icon 526. Referring again to FIG. 1B, the movement of the slider icon 526 causes the remote electronic device 133 to transmit a message to the microcontroller 124 indicating a desired brightness level. In this use case, since the triac dimmer 104 is at a maximum output configuration, the control circuit is configured such that the microcontroller 124 controls the dimming of the light-emitting devices 107 and 109. The microcontroller, via a GPIO or other peripheral, provides a signal to the dimming circuit 112 via control circuit 114 to operate the brightness and/or CCT value of the light-emitting devices. An additional message 527 may be presented on the user interface, indicating that the dimming can be controlled by moving the slider icon 526.

FIG. 6 shows a user interface 600 indicating wireless control is disabled.

Referring again to FIG. 1A, when the triac dimmer 104 is not at a maximum output configuration, the control circuit is configured such that the triac dimmer 104 controls the dimming of the light-emitting devices 107 and 109. In this use case, the dimming control 624 may be disabled, grayed out, or otherwise deactivated such that movement of the slider icon 626 is not possible and/or has no effect. An additional message 627 may be presented on the user interface, indicating that dimming is currently controlled by the wall dimmer (triac).

As can now be appreciated, disclosed embodiments provide an apparatus that includes a triac dimming device, an LED driver and a light-emitting device, where the LED driver is coupled to a wireless dimming module. When triac dimming is at a high position, the power wireless dimming module can receive a wireless signal and change at least one of the brightness, color temperature or color of the light-emitting device. Thus, disclosed embodiments enable use of a wall-mounted dimming switch that includes a triac, as well as use with a wireless controller, such as a smartphone executing an application (app) to control brightness and/or CCT values. In this way, improved convenience and control of LED lighting is achieved.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, circuits, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed is:

1. An apparatus comprising:

an LED driver, the LED driver comprising a control circuit and a dimming circuit, wherein the dimming circuit is configured and disposed to receive an input signal from the control circuit;

a triac included in a wall-mounted dimming switch, the triac configured and disposed to provide a first signal to the control circuit;

a microcontroller, configured and disposed to provide a second signal to the control circuit; and a wireless communication interface coupled to the microcontroller, and wherein the control circuit is configured and disposed to provide the first signal to the dimming circuit when the first signal is below a predetermined threshold, and wherein the control circuit includes a sensing circuit, and wherein the sensing circuit is configured and disposed to detect a maximum output level of the first signal, and wherein the control circuit, in response to detecting a maximum output level of the first signal, provides the first signal to the dimming circuit, wherein the first signal is controlled by the wall-mounted dimming switch, and wherein the control circuit, in response to detecting an output level of the first signal that is not at maximum output, provides the second signal to the dimming circuit, wherein the second signal is controlled by a remote device via the wireless communication interface.

2. The apparatus of claim 1, further comprising a plurality of LEDs, wherein each LED of the plurality of LEDs are coupled to the LED driver.

3. The apparatus of claim 2, wherein the plurality of LEDs comprises a first LED and a second LED.

4. The apparatus of claim 3, wherein the first LED is configured to emit a first white light of a first correlated color temperature (CCT); and wherein the second LED is configured to emit a second white light of a second CCT.

5. The apparatus of claim 3, wherein the first LED and second LED comprise RGB (red-green-blue) LEDs.

6. The apparatus of claim 1, wherein the wireless communication interface includes a Wi-Fi interface.

7. The apparatus of claim 1, wherein the wireless communication interface includes a Bluetooth interface.

8. The apparatus of claim 1, wherein the wireless communication interface includes a ZigBee interface.

9. The apparatus of claim 1, wherein the wireless communication interface includes an infrared (IR) interface.

10. The apparatus of claim 1, wherein the control circuit is configured and disposed to provide a switch selection signal as an input to the microcontroller.

11. An apparatus comprising:

an integrated control unit, comprising:

an LED driver, the LED driver comprising a control circuit and a dimming circuit, wherein the dimming circuit is configured and disposed to receive an input signal from the control circuit;

a triac configured and disposed to provide a first signal to the control circuit;

a microcontroller, configured and disposed to provide a second signal to the control circuit; and a wireless communication interface coupled to the microcontroller, and wherein the control circuit is configured and disposed to provide the first signal to the dimming circuit when the first signal is below a predetermined threshold, and wherein the control circuit includes a sensing circuit, and wherein the sensing circuit is configured and disposed to detect a maximum output level of the first signal, and wherein the control circuit, in response to detecting a maximum output level of the first signal, provides the first signal to the dimming circuit, wherein the first signal is controlled by the triac, and wherein the control circuit, in response to detecting an output level of the first signal that is not at maximum output, provides the second signal to the dimming circuit, wherein the second signal is controlled by a remote device via the wireless communication interface.

12. The apparatus of claim 11, further comprising a plurality of LEDs, wherein each LED of the plurality of LEDs are coupled to the integrated control unit.

13. The apparatus of claim 12, wherein the plurality of LEDs comprises a first LED and a second LED.

14. The apparatus of claim 13, wherein the first LED is configured to emit a first white light of a first correlated color temperature (CCT), and wherein the second LED is configured to emit a second white light of a second CCT.

15. The apparatus of claim 13, wherein the first LED and second LED comprise RGB (red-green-blue) LEDs.

16. The apparatus of claim 11, wherein the wireless communication interface includes a Wi-Fi interface.

17. The apparatus of claim 11, wherein the wireless communication interface includes a Bluetooth interface.

18. The apparatus of claim 11, wherein the wireless communication interface includes a ZigBee interface.

19. The apparatus of claim 11, wherein the wireless communication interface includes an infrared (IR) interface.

20. The apparatus of claim 11, wherein the control circuit is configured and disposed to provide a switch selection signal as an input to the microcontroller.

* * * * *